US009587345B2

(12) United States Patent
Cho

(10) Patent No.: US 9,587,345 B2
(45) Date of Patent: Mar. 7, 2017

(54) DRUM-TYPE WASHER AND TUB CLEANING METHOD OF THE SAME

(75) Inventor: Han Ki Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 12/307,522

(22) PCT Filed: Jul. 3, 2007

(86) PCT No.: PCT/KR2007/003222

§ 371 (c)(1),
(2), (4) Date: Nov. 20, 2009

(87) PCT Pub. No.: WO2008/004801

PCT Pub. Date: Jan. 10, 2008

(65) Prior Publication Data

US 2010/0065086 A1 Mar. 18, 2010

(30) Foreign Application Priority Data

Jul. 4, 2006 (KR) ..... 10-2006-0062472

(51) Int. Cl.
*B08B 7/00* (2006.01)
*B08B 9/00* (2006.01)
(Continued)

(52) U.S. Cl.
CPC ..... *D06F 39/008* (2013.01); *D06F 33/02* (2013.01); *D06F 35/005* (2013.01); *D06F 35/008* (2013.01); *D06F 2204/065* (2013.01)

(58) Field of Classification Search
USPC ..... 134/19, 18, 22.1, 22.12, 22.15, 23, 42, 134/56 R, 201, 26, 30
See application file for complete search history.

(56) References Cited

U.S. PATENT DOCUMENTS 2,887,862 A * 5/1959 Jennings ..... 68/12.15
3,583,182 A * 6/1971 Matsuura ..... D06F 37/203 210/144
(Continued)

FOREIGN PATENT DOCUMENTS

CN 1616743 A 5/2005
DE 197 42 282 C1 2/1999
(Continued)

OTHER PUBLICATIONS

English Translation of DE19751028.*

*Primary Examiner* — Eric Golightly
*Assistant Examiner* — Arlyn I Rivera-Cordero
(74) *Attorney, Agent, or Firm* — Birch, Stewart, Kolasch & Birch, LLP

(57) ABSTRACT

A drum-type washer capable of easily cleaning a tub and a method of cleaning the tub of the drum-type washer are disclosed. The drum-type washer includes a tub installed in a cabinet to be supplied with washing water, a drum rotatably disposed in the tub such that laundry articles are loaded into the drum, a motor which rotates the drum, a controller which controls a rotational velocity of the motor to rotate the drum at a specified rotational velocity such that the washing water circulates along an inner peripheral surface of the tub to clean the inner peripheral surface of the tub, and a steam supply device which is controlled by the controller to supply high-temperature, high-pressure steam into the tub and the drum.

10 Claims, 2 Drawing Sheets

(51) Int. Cl.

| | |
|---|---|
| ***B08B 3/00*** | (2006.01) |
| ***D06F 39/00*** | (2006.01) |
| ***D06F 33/02*** | (2006.01) |
| ***D06F 35/00*** | (2006.01) |

(56) References Cited

U.S. PATENT DOCUMENTS

| | | | | | |
|---|---|---|---|---|---|
| 4,231,130 | A * | 11/1980 | Tobita et al. | ..... | 8/159 |
| 7,585,374 | B2 * | 9/2009 | Sechelmann | ..... | 134/18 |
| 2004/0255391 | A1 | 12/2004 | Kim et al. | | |
| 2006/0102202 | A1 * | 5/2006 | Park | ..... | 134/22.1 |
| 2006/0151005 | A1 * | 7/2006 | Kim et al. | ..... | 134/22.1 |
| 2008/0095660 | A1 * | 4/2008 | Wong et al. | ..... | 422/11 |

FOREIGN PATENT DOCUMENTS

| | | | | | |
|---|---|---|---|---|---|
| DE | 197 51 028 | A1 | | 5/1999 | |
| DE | 19751028 | | * | 5/1999 | ..... D06F 35/00 |
| EP | 1 365 057 | A1 | | 11/2003 | |
| EP | 1365057 | | * | 11/2003 | ..... D06F 58/22 |
| EP | 1 469 120 | A1 | | 10/2004 | |
| EP | 1 681 384 | A1 | | 7/2006 | |
| JP | 02-241493 | A | | 9/1990 | |
| JP | 2005-065923 | A | | 3/2005 | |
| KR | 10-2004-0046937 | A | | 6/2004 | |
| KR | 10-2006-0085961 | A | | 7/2006 | |
| KR | 10-2006-0101951 | A | | 9/2006 | |
| RU | 2221094 | C1 | | 1/2004 | |
| SU | 1834720 | A3 | | 8/1993 | |
| WO | WO2007055475 | | * | 5/2007 | ..... D06F 33/02 |
| WO | WO2007073012 | | * | 6/2007 | ..... D06F 359/00 |

* cited by examiner

DRUM-TYPE WASHER AND TUB CLEANING METHOD OF THE SAME

TECHNICAL FIELD

The present invention relates to a washer, and more particularly to a drum-type washer capable of easily cleaning a tub and a method of cleaning the tub of the drum-type washer.

BACKGROUND ART

Generally, a drum-type washer performs a washing operation using a frictional force between a drum rotating by a driving force of a motor and laundry articles and a dropping impact of the laundry articles in a state where a detergent, washing water and the laundry articles are loaded in the drum. In the drum-type washer, there is little damage on the laundry articles, the laundry articles are not tangled with each other, and a washing effect of beating and rubbing can be provided.

Compared to the drum-type washer, a pulsator-type washer includes a water-extracting tub in a water tank which stores the washing water. In the pulsator-type washer, a washing operation is performed in a state where the laundry articles are soaked in the washing water supplied into the water-extracting tub, thereby consuming a large amount of water.

In the pulsator-type washer, the washing operation is performed by action of a detergent and friction between the washing water and the laundry articles due to the rotation of the water-extracting tub or the rotation of a pulsator disposed at a lower portion of the water-extracting tub to form water current.

That is, in the drum-type washer, a rotation shaft of the drum is formed substantially parallel to the ground. Accordingly, even when a small amount of washing water is stored in the tub and the drum, the washing operation is performed by dropping of the laundry articles. However, in the pulsator-type washer, a rotation shaft of the water-extracting tub is formed substantially perpendicular to the ground. Accordingly, only when the washing water is supplied such that the laundry articles are soaked in the washing water, the washing operation can be performed.

Meanwhile, in a conventional pulsator-type washer, the washing water is always full to an upper portion of the water tank. The filling of the water tank is repeated every time the washer is operated.

High efficiency, drum-style, front-load washing machines are designed to use less water, less energy and high efficiency detergent. If, contrary to the manufacturer's instructions, the operator of the washing machine regularly uses regular detergent, rather than high efficiency detergent, or regularly uses more than the recommended amount of high efficiency detergent and if the operator does not perform the regular maintenance recommended by the manufacturer, it is possible that excessive volumes of suds and foam may result and that this may lead to the accumulation of undissolved detergent and soil inside the washing machine. The accumulation of undissolved detergent and soil inside the washing machine due to misuse may lead to development of mold which can in turn produce an odor that some perceive to be unpleasant.

In this case, since the water tank is not operated, contaminants or fur may be deposited on the lower portion and the inner peripheral surface of the water tank. Further, as time goes by, the contaminants or fur may be decomposed, thereby generating an offensive smell or contaminating the laundry articles.

Thus, in the conventional pulsator-type washer, various methods have been proposed to clean the inner peripheral surface of the water tank. However, in a state where the water tank is filled with the washing water, it is uneasy to clean the water tank by the fast flowing water generated by rotating the water-extracting tub at a high speed without using an additional device for the following reason.

In the high-speed rotation of the water-extracting tub, a large load is exerted on the motor due to the frictional force between the washing water and the outer surface of the water-extracting tub. Even when the water-extracting rotates at a high speed, it is difficult that the washing water reaches the upper inner peripheral surface of the water tank.

Thus, in the conventional pulsator-type washer, a special detergent is used to clean the water tank by action of the detergent in a general washing or rinsing operation.

However, generally, the detergent for cleaning the water tank has a large amount of chemical components for a strong cleaning force, which cause water pollution, differently from the detergent for washing. Accordingly, the detergent for cleaning the water tank is not friendly to the environment.

FIG. 1 is a diagram showing a schematic configuration of a general drum-type washer. The general drum-type washer is described with reference to FIG. 1.

As shown in FIG. 1, the drum-type washer includes a cabinet 1 having a laundry loading port formed on its front surface, a door 2 installed on the laundry loading port of the cabinet 1 to open/close the laundry loading port, a tub 10 installed in the cabinet 1 to store the washing water therein, a motor 4 installed at the tub 10 to generate a drive force, a washing shaft 5 connected to the motor 4, and a drum 6 connected to the washing shaft 5 to wash laundry articles by the drive force transferred from the motor 4.

The tub 10 is supported by a damper 11 and a spring 23. The damper 11 and spring 23 serve to absorb the vibration generated in the rotations of the motor 4 and the drum 6.

The motor 4 includes a rotor (not shown) and a stator (not shown).

In the drum-type washer having the above configuration, the washing water is supplied such that only lower portions of the tub 10 and the drum 6 are soaked in the washing water differently from the pulsator-type washer. Further, only a portion of the washing water stored in the lower portion of the tub is lifted up with the washing water by a lifter (not shown) provided in the drum and then dropped.

Accordingly, in the drum-type washer differently from the pulsator-type washer, opposite side portions and an upper portion of the inner peripheral surface of the tub are not soaked in the washing water.

Thus, in the conventional drum-type washer, it is not considered that the contaminants or fur may be accumulated due to misuse on the opposite side portions of the inner peripheral surface of the tub, particularly, on the upper portion of the inner peripheral surface of the tub. Accordingly, it is not required to clean the contaminants deposited on those positions.

Meanwhile, although a term of "tub cleaning" is used in the conventional drum-type washer, the term of "tub cleaning" does not mean the cleaning of the opposite side portions of the inner peripheral surface of the tub, particularly, on the upper portion of the inner peripheral surface of the tub. That is, it means cleaning of only the lower portion of the inner peripheral surface of the tub.

However, applicants of the present invention found the fact that the contaminants and fur are accumulated due to misuse on the opposite side portions and an upper portion of the inner peripheral surface of the tub as well as the lower portion thereof, thereby generating an offensive smell or contaminating the laundry articles.

Therefore, it is required to find a method for easily cleaning the entire inner peripheral surface of the tub without using an additional device for cleaning the tub.

DISCLOSURE OF INVENTION

Technical Problem

An object of the present invention devised to solve the problem lies on a drum-type washer and a tub cleaning method of the drum-type washer capable of easily cleaning the tub by circulating the washing water along the inner surface of the tub and performing sterilization.

Technical Solution

The object of the present invention can be achieved by providing a drum-type washer comprising: a tub installed in a cabinet to be supplied with washing water; a drum rotatably disposed in the tub such that laundry articles are loaded into the drum; a motor which rotates the drum; a controller which controls a rotational velocity of the motor to rotate the drum at a specified rotational velocity such that the washing water circulates along an inner peripheral surface of the tub to clean the inner peripheral surface of the tub; and a steam supply device which is controlled by the controller to supply high-temperature, high-pressure steam into the tub and the drum.

Preferably, the drum-type washer further includes a heater which is controlled by the controller and disposed in the tub to heat the supplied washing water.

Preferably, the drum-type washer further includes an input unit which receives an operation command for cleaning the inner peripheral surface of the tub.

Preferably, the controller controls a rotational velocity of the drum to be greater than a velocity set in a washing or rinsing operation and smaller than a velocity set in a water-extracting operation.

Preferably, the controller controls such that the drum rotates at about four times to five times a preset rotational velocity of the drum in the washing operation.

Preferably, the controller controls a water level of the washing water supplied in the tub such that the washing water circulates along the inner peripheral surface of the tub.

Preferably, the controller controls such that the rotational velocity of the drum increases as the water level of the washing water supplied in the tub decreases.

Preferably, the controller controls a portion of the washing water circulating in the drum to be higher than a lowest water level and lower than a full water level.

Preferably, the controller controls the water level of the washing water supplied in the tub and the rotational velocity of the drum such that the portion of the washing water circulating in the drum flows into a lower side of a gasket disposed between the door and the tub to clean the gasket.

Preferably, the controller controls the water level of the washing water supplied in the drum to be higher than a preset water level in the rinsing operation.

In accordance with another aspect of the present invention, there is provided a tub cleaning method of a drum-type washer comprising: a water storing step in which washing water flows into a tub to be stored in the tub; a steeping step in which high-temperature, high-pressure steam is supplied into the tub and a drum; and a cleaning step in which the washing water in the tub circulates along an inner peripheral surface of the tub by controlling a rotational velocity of the drum to clean the inner peripheral surface of the tub.

Preferably, the tub cleaning method further includes a heating step in which the stored washing water is heated.

Preferably, the tub cleaning method further includes an inputting step in which an operation command for cleaning the inner peripheral surface of the tub is inputted by a user.

Preferably, the tub cleaning method further includes a rinsing step in which water drain and cleaning of the inner peripheral surface of the tub are repeated after the cleaning step such that contaminants removed from the tub do not remain in the tub and the drum.

Preferably, forward and backward rotation of the drum is repeated in the cleaning step.

Preferably, the tub cleaning method further includes a clothes amount sensing step for sensing whether laundry articles are loaded in the drum.

Advantageous Effects

According to the present invention, there are provided a drum-type washer and a tub cleaning method of the drum-type washer capable of easily cleaning the entire inner peripheral surface of the tub without using an additional device for cleaning the tub.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
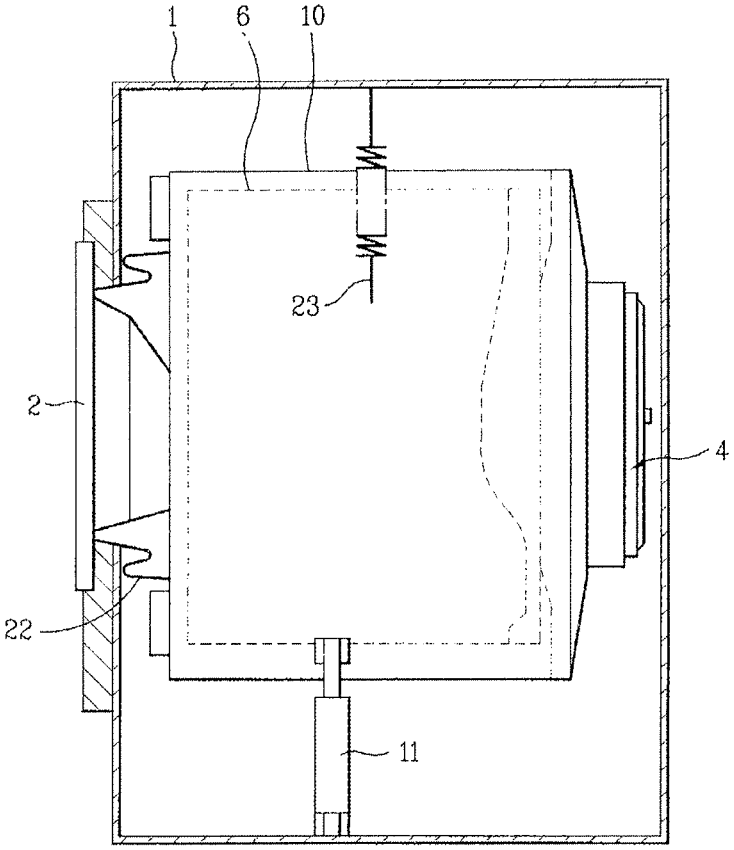
Fig. 1 PRIOR ART
FIG. 1 illustrates a diagram showing a schematic configuration of a general drum-type washer.
Figure 2:
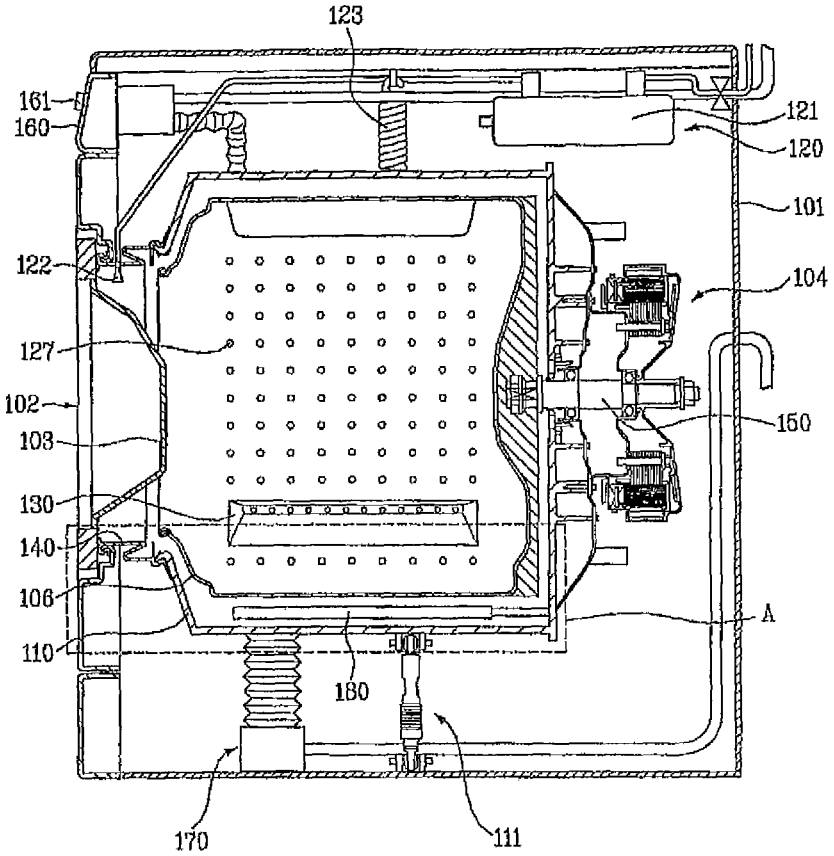
FIG. 2 illustrates cross-sectional view schematically showing a configuration of a drum-type washer according to the present invention.

Hereinafter, a configuration of a drum-type washer according to the present invention will be described in detail with reference to FIG. 2. FIG. 2 is a cross-sectional view schematically showing a configuration of the drum-type washer according to the present invention. The detailed description of the above-mentioned configuration is omitted to avoid redundancy.

Further, in this specification, washing water for a washing operation and washing water for cleaning a tub are simply referred to as washing water.

As shown in FIG. 2, the drum-type washer according to the present invention includes a tub 110, a drum 106, and a motor 104 which rotates the drum 106, and a controller 160 which controls a rotational velocity of the motor 104 such that washing water supplied into the tub 110 reaches an upper portion of an inner peripheral surface of the tub 110 to clean the inner peripheral surface of the tub 110.

FIG. 2 shows a direct driving type structure wherein the motor 104 is directed connected to a rotation shaft 150 to drive the drum 106, but it is not limited thereto.

Further, FIG. 2 shows the structure having the controller 160 provided on a control panel disposed on a front surface of a cabinet 101, but it is not limited thereto.

The tub 110 is installed in a cabinet 101 to be connected to a spring 123 and a friction damper 111. The washing water is supplied into the tub 110.

The drum 106 is rotatably disposed in the tub 110. The drum 106 communicates with the outside such that laundry articles are loaded into the drum 106.

A lifter 130 is disposed in the drum 106. The lifter 130 serves to lift up a portion of the laundry articles or washing water and drop it when the drum 106 is rotated.

Further, a plurality of through holes 127 are formed on a sidewall of the drum 106. The drum 106 communicates with the tub 110 via the through holes 127.

A driving force for rotating the drum 106 is generated by the motor 104. The driving force is transmitted to the drum 106 through the rotation shaft 150.

Meanwhile, a door 102 is provided on the front surface of the cabinet 101. The inside of the drum 106 selectively communicates with the outside by the door 102.

That is, a user can load the laundry articles into the drum 106 or unload the laundry articles from the drum 106 by opening/closing the door 102.

A protruding part 103 may be formed on the door 102 at the side of the drum 106. The protruding part 103 allows the laundry articles to be washed only in the drum 106.

Further, a gasket 140 is disposed between the door 102 and the tub 110 to prevent water leakage.

Meanwhile, the drum-type washer according to the present invention further includes a steam supply device 120 which supplies high-temperature, high-pressure steam into the tub 110 and the drum 106.

The steam supply device 120 includes a steam generator 121 for generating steam and a steam supplier 122 for supplying the generated steam into the tub 110 and the drum 106. Accordingly, high-temperature, high-pressure steam can be supplied into the drum 106 by the steam supply device 120.

Further, a heater 180 is disposed at the lower side of the tub 110 of the drum-type washer according to the present invention to heat the supplied washing water.

Further, the drum-type washer according to the present invention further includes an input unit 161. An operation command for cleaning the inner peripheral surface of the tub 110 is inputted through the input unit 161.

That is, in a general drum-type washer, rotary knobs or buttons may be disposed on the control panel to input operation commands of the drum-type washer. Accordingly, an input portion for cleaning the tub 110 may be provided in a rotary knob or an additional button for cleaning the tub 110 may be provided.

Further, when a conventional operation mode is inputted, cleaning of the tub 110 may be also performed.

Further, the drum-type washer according to the present invention includes the controller 160 which controls the operation of the drum-type washer.

The controller 160 controls the operation of the motor 104 for driving the drum 106, particularly, the rotational velocity of the motor 104. That is, the controller 160 controls the drum 106 to rotate at preset rotational velocities according to washing, rinsing and water-extracting operations under inputted operation conditions.

However, the controller 160 of the drum-type washer according to the present invention controls the rotational velocity of the drum 106 within a rotational velocity range different from the above-mentioned rotational velocities of the drum 106. In the rotational velocity range, preferably, the washing water can reach the upper portion of the inner peripheral surface of the tub 110.

That is, the controller 160 controls the drum 106 to rotate at a rotational velocity greater than the preset rotational velocity according to the washing or rinsing operation such that the washing water can reach the upper portion of the inner peripheral surface of the tub 110 by a centrifugal force or a frictional force.

Further, preferably, the controller 160 controls the rotational velocity of the drum 106 such that the washing water can reach the upper portion of the inner peripheral surface of the tub 110 and then circulate again.

Namely, when the washing water continuously circulates along the inner peripheral surface of the tub 110, it is possible to clean contaminants or fur formed on the inner peripheral surface of the tub 110 with the fast flowing water.

Meanwhile, preferably, during the cleaning of the tub 110, the controller 160 controls the rotational velocity of the drum 106 to be smaller than the rotational velocity in the water-extracting operation to prevent an overload.

Preferably, the drum 106 rotates at an optimal rotational velocity for cleaning the tub 110. That is, preferably, the drum 106 rotates at a rotational velocity for efficiently cleaning the tub 110.

The optimal rotational velocity is greatly related to a water level of the washing water supplied into the tub 110. The optimal rotational velocity should be smaller than the rotational velocity in the water-extracting operation while taking the noises and the load of the motor into account.

An experiment was conducted to obtain optimal rotational velocity from the rotational velocity of the drum 106 in the washing or rinsing operation and the rotational velocity of the drum 106 in the water-extracting operation. It was seen from the experiment that the tub 110 can be efficiently cleaned when the drum 106 rotates at about four times to five times the rotational velocity in the washing or rinsing operation.

That is, when the rotational velocity of the drum 106 in the washing or rinsing operation is 40 to 50 RPM, the optimal rotational velocity for cleaning the tub 110 is about 160 to 250 RPM. Accordingly, the tub 110 can be efficiently cleaned at the rotational velocity of 160 to 250 RPM.

Further, the controller 160 performs the control of the heater 180 and the steam supply device 120.

That is, the controller 160 appropriately controls a heating process for heating the supplied washing water and a steam supply process to increase the effect of cleaning the tub 110.

Figure 3:
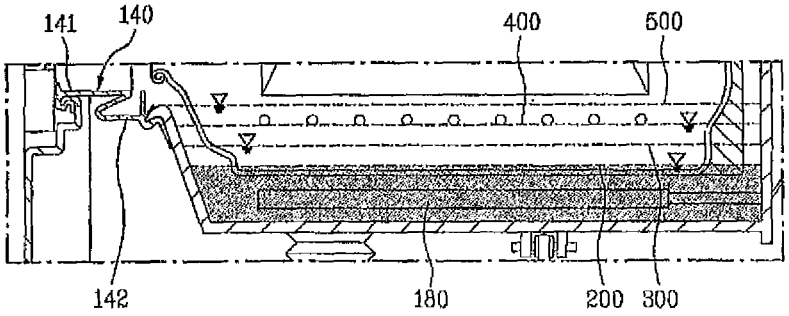
FIG. 3 illustrates an enlarged view of a portion indicated by A of FIG. 2.

Hereinafter, a water level controlling process for cleaning the tub of the drum-type washer according to the present invention will be described with reference to FIG. 3. FIG. 3 is an enlarged view of a lower portion of the tub and the drum of the drum-type washer shown in FIG. 2.

As shown in FIG. 3, the uppermost dotted line indicates a full water level 500. That is, the full water level is referred to as a water level at which the washing water is full in the tub 110 and the drum 106 to overflow into the gasket 140. The other dotted lines indicate a gasket cleaning water level 400, a rinsing water level 300 and a washing water level 200, which are not absolute water levels but relative water levels.

Further, the relative water levels are given in the similar way in a tilt-type, drum-type washer in which the rotation shaft 150 is tilted at a specified angle with respect to the ground as well as the drum-type washer in which the rotation shaft 150 is formed parallel to the ground. In this case, an upper portion of the drum is positioned higher than a lower portion of the drum with respect to the ground. Accordingly, the heights of the upper portion and the lower portion of the drum soaked in water are different at the respective water levels.

Further, the controller 160 should control the water level of a portion of the circulating washing water in the drum to be higher than the lowest water level and lower than the full water level. The control of the water level is performed such that the washing water circulates along the inner peripheral surface of the tub 110 while taking the load of the motor 104 into account.

First, for the cleaning of the tub 110 or efficient washing, the water level of the washing water supplied into the tub 110 should be equal to or greater than the washing water level 200. Although a lower portion of the drum 106 is slightly soaked in the washing water in FIG. 3, if even a small portion of the drum 106 is not soaked in the washing water, only the drum 106 rotates regardless of the magnitude of the rotational velocity of the drum 106.

Thus, the controller 160 should control the water level of the washing water supplied into the tub 110 such that the washing water can circulate along the inner peripheral surface of the tub 110.

Further, at the full water level, the washing water may be pushed toward the door, thereby causing water leakage. Also, it is possible to cause the noises and vibration due to an increased frictional force between the drum and the washing water.

Further, the overload of the motor 150 may be generated. Preferably, the water level of the washing water for cleaning the tub 110 is controlled to be smaller than the full water level.

Meanwhile, the rinsing water level 300 is generally higher than the washing water level 200 to rinse a detergent or contaminants out of the laundry articles.

At the rinsing water level 300, when the washing water circulates along the inner peripheral surface of the tub 110, it is possible to efficiently clean the tub as described above.

In this case, however, it matters whether the washing water circulates in the drum 106. If there is no washing water in the drum 106 during the cleaning of the tub, namely, if the user determines there is no washing water in the drum 106 through the door 102, there is a problem that the user cannot visually check whether the cleaning of the tub is performed at that time.

Thus, preferably, the washing water level is controlled such that a portion of the washing water circulates in the drum 106.

Further, preferably, the controller 160 controls the water level of the washing water to clean the gasket 140 by the washing water circulating in the drum 106 or the washing water which is lifted up with the rotation of the drum 106 and falls down along the side surface without circulating along the inner peripheral surface of the tub 110.

As shown in FIG. 3, the gasket 140 includes a door side portion 141 and a tub side portion 142. The tub side portion 142 is formed to be recessed. Accordingly, detergent remnants, contaminants or fur may be easily deposited on the tub side portion 142, but they cannot be seen by the user. Consequently, those contaminants may cause an offensive smell or contamination of the laundry articles.

Thus, it is necessary to remove the contaminants. According to the present invention, the gasket 140 can be cleaned simultaneously with the cleaning of the tub 110 without an additional device for cleaning the gasket 140.

That is, in order to clean the gasket 140, the water level of the washing water should be controlled to be higher than the rinsing water level such that a portion of the washing water circulating in the drum is circulated into the gasket 140 during the cleaning of the tub 10. On the other hand, the water level of the washing water should be controlled to be lower than the water level at which the gasket 140 is entirely soaked in the washing water during the cleaning of the tub 10.

Accordingly, it is possible to clean a lower portion of the gasket 140 with the fast flowing water according to the circulation of the washing water.

Hereinafter, a method of cleaning the tub of the drum-type washer according to the present invention will be described.

First, a water storing step is performed such that the washing water for cleaning the tub flows into the tub 110 to be stored therein.

Then, while the washing water flows into the tub 110 or after the water storing step is completed, a cleaning step is performed to clean the tub 110 by heating the stored washing water, supplying steam and rotating the drum.

Basically, in the cleaning step, the washing water circulates along the inner peripheral surface of the tub 110 to clean the inner peripheral surface of the tub 110.

That is, the inner peripheral surface of the tub 110 is cleaned with the fast flowing water. In this case, the rotational velocity of the drum 106 should be greater than the rotational velocity at which the washing water can circulate along the inner peripheral surface of the tub 110.

Meanwhile, the water storing step may be performed after an inputting step in which an operation command for cleaning the inner peripheral surface of the tub 110 is inputted by the user. That is, the tub 110 is cleaned using an additional input unit for cleaning the tub 110 independent of the other operations.

The method of cleaning the tub of the drum-type washer according to the present invention includes a steeping step in which the moisture and heat are applied to the contaminants or fur during the rotation of the drum to activate the contaminants or fur such that the contaminants or fur can be easily removed.

The steeping step is performed by supplying steam into the tub 110 and the drum 106.

Specifically, the steeping step is performed before, after or during the water storing step by supplying high-temperature, high-pressure steam into the tub 110 and the drum 106 such that the contaminants are steeped in a high-temperature, high-humidity state of the tub 110 and the drum 106.

Further, the method of cleaning the tub of the drum-type washer according to the present invention includes a heating step in which the washing water is heated to maintain the washing water at a high temperature. Accordingly, it is possible to strengthen the sterilization function during the cleaning of the tub 110 and efficiently remove the fur formed on the tub 110.

The heating step for heating the washing water may be performed at the same time with the steeping step for supplying the steam. Further, the heating step and the steeping step may be alternately performed. Accordingly, it is possible to surely perform the removal of the contaminants and the sterilization.

Preferably, the steeping step for supplying the steam is performed for a specified period of time to remove the contaminants. Then, the heating step for heating the stored washing water is performed for a specified period of time to surely perform the removal of the contaminants and the sterilization of the tub.

The rotation of the drum is also performed in the steeping step and the heating step.

Meanwhile, in the method of cleaning the tub, it is preferable to perform a clothes amount sensing step for sensing whether the laundry articles are loaded in the drum in advance.

The clothes amount sensing step is performed for the following reason: if the laundry articles are loaded in the drum in a tub cleaning process, both washing of the laundry articles and cleaning of the tub cannot be sufficiently performed due to the contaminants.

Thus, in case of sensing the clothes amount, the controller notifies the user using a proper alarm device, so that the tub cleaning process is not directly performed.

The alarm device notifies the user through a display or speaker such that the tub cleaning process is not performed.

Meanwhile, the method of cleaning the tub of the drum-type washer according to the present invention includes a rinsing step for discharging the contaminants removed in the cleaning step to the outside.

Specifically, in the rinsing step, the water drain and the cleaning of the inner peripheral surface of the tub are repeated after the cleaning step such that the removed contaminants do not remain in the tub and the drum.

Finally, in the cleaning step of the method of cleaning the tub of the drum-type washer according to the present invention, the drum may repeatedly rotate forward and backward.

That is, the inner peripheral surface of the tub or the gasket may be efficiently cleaned by changing the direction of the fast flowing water.

Although the drum-type washer in which the rotation shaft of the drum is formed substantially parallel to the ground is described in the present invention, the present invention is not limited thereto.

Further, the present invention may be also applied to the tilt-type, drum-type washer in which the rotation shaft of the drum is tilted at a specified angle with respect to the ground.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

As described above, a tub structure of the drum-type washer of the present invention has the following effects.

First, according to the present invention, it is possible to surely remove the contaminants, fur or the like by supplying the steam and heating the supplied washing water at the same time.

Second, according to the present invention, it is possible to easily clean the tub without using an additional device for cleaning the tub.

Third, it is unnecessary to use a special detergent for cleaning the tub. Even if the special detergent is necessary, the tub can be efficiently cleaned using a small amount of the detergent. Accordingly, it is possible to clean the tub to be friendly to the environment.

Fourth, it is possible to have a sterilization function by heating the washing water using a heater while the tub is cleaned.

The invention claimed is:

1. A tub cleaning method of a drum-type washer comprising:

a water storing step in which washing water flows into a tub to be stored in the tub;

a steeping step in which steam is supplied into the tub and a drum; and a cleaning step in which the washing water in the tub circulates along an entire inner peripheral surface of the tub by controlling a rotational velocity of the drum to clean the entire inner peripheral surface of the tub, wherein a rotational velocity of the drum in the cleaning step is greater than a rotational velocity of the drum set in a washing or rinsing operation and smaller than a rotational velocity of the drum set in a water-extracting operation, and wherein a centrifugal force generated by the rotational velocity of the drum in the cleaning step is greater than a centrifugal force generated by the rotational velocity of the drum set in the washing or rinsing operation and smaller than a centrifugal force generated by the rotational velocity of the drum set in the water-extracting operation.

2. The tub cleaning method according to claim 1, further comprising a heating step in which the stored washing water is heated.

3. The tub cleaning method according to claim 1, further comprising an inputting step in which an operation command for cleaning the inner peripheral surface of the tub is inputted by a user.

4. The tub cleaning method according to claim 1, further comprising a rinsing step in which water drain and cleaning of the inner peripheral surface of the tub are repeated after the cleaning step such that contaminants removed from the tub do not remain in the tub and the drum.

5. The tub cleaning method according to claim 1, wherein forward and backward rotation of the drum is repeated in the cleaning step.

6. The tub cleaning method according to claim 1, further comprising a clothes amount sensing step for sensing whether laundry articles are loaded in the drum.

7. The tub cleaning method according to claim 1, wherein the rotational velocity of the drum increases in the cleaning step as a water level of the washing water supplied in the tub decreases.

8. The tub cleaning method according to claim 1, wherein the washing water is supplied in the water storing step to a level which is higher than a lowest water level and is lower than a full water level.

9. The tub cleaning method according to claim 1, wherein a level of the washing water supplied in the water storing step is higher than a preset water level in a rinsing operation.

10. The tub cleaning method according to claim 1, wherein a portion of the washing water circulating in the drum flows into a lower side of a gasket disposed between a door and the tub of the drum-type washer to clean the gasket in the cleaning step.

* * * * *